US008181359B2

(12) United States Patent
Bae et al.

(10) Patent No.: US 8,181,359 B2
(45) Date of Patent: May 22, 2012

(54) LAUNDRY MACHINE

(75) Inventors: Sang Hun Bae, Changwon-si (KR); Dong Geun Lee, Changwon-si (KR); Yeon Sik Choi, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1021 days.

(21) Appl. No.: 12/149,018

(22) Filed: Apr. 24, 2008

(65) Prior Publication Data

US 2008/0276660 A1 Nov. 13, 2008

(30) Foreign Application Priority Data

Apr. 25, 2007 (KR) ..... 10-2007-0040320
May 2, 2007 (KR) ..... 10-2007-0042697

(51) Int. Cl.
*F26B 25/06* (2006.01)

(52) U.S. Cl. ..... 34/604; 34/610; 134/22.12; 8/158; 8/137; 68/12.18; 68/12.22

(58) Field of Classification Search ..... 34/68, 82, 34/329, 565, 604, 605, 606, 610; 68/12.18, 68/12.22; 8/158, 137; 134/22.12
See application file for complete search history.

(56) References Cited

U.S. PATENT DOCUMENTS

| | | | | |
|---|---|---|---|---|
| 2,742,708 | A * | 4/1956 | McCormick | 34/76 |
| 3,595,036 | A * | 7/1971 | DePas | 68/12.15 |
| 6,796,055 | B2 * | 9/2004 | Baltes | 34/449 |
| 7,251,905 | B2 * | 8/2007 | Doh et al. | 34/603 |
| 7,913,419 | B2 * | 3/2011 | Tomasi et al. | 34/595 |
| 2008/0276660 | A1 * | 11/2008 | Bae et al. | 68/5 C |
| 2008/0276661 | A1 * | 11/2008 | Bae et al. | 68/5 C |
| 2008/0282751 | A1 * | 11/2008 | Yoon et al. | 68/5 C |

FOREIGN PATENT DOCUMENTS

| | | | |
|---|---|---|---|
| EP | 1932963 | A1 * | 6/2008 |
| KR | 1987-0015180 | U | 10/1987 |
| KR | 1997-0044445 | U | 7/1997 |
| KR | 10-2003-0080343 | A | 10/2003 |
| KR | 10-2005-0068482 | A | 7/2005 |
| KR | 10-0698132 | B1 | 3/2007 |
| KR | 10-2008-0007869 | A | 1/2008 |
| WO | WO 2008010671 | A2 * | 1/2008 |

* cited by examiner

*Primary Examiner* — Stephen M. Gravini
(74) *Attorney, Agent, or Firm* — McKenna Long & Aldridge LLP

(57) ABSTRACT

A laundry machine is disclosed. The disclosed laundry machine includes a drum rotatably provided in a cabinet; a substance supply device generating water based substance and supplying the water based substance to the drum; a water supply device that is movably provided in the cabinet and supplies water to the substance supply device; and a first stopper confining a position of the water supply device when the water supply device is pulled out from the cabinet.

17 Claims, 9 Drawing Sheets

LAUNDRY MACHINE

This application claims the benefit of Korean Patent Application Nos. 10-2007-0040320, filed on Apr. 25, 2007 and 10-2007-0042697, filed on May 2, 2007 which are hereby incorporated by reference as if fully set forth herein.

BACKGROUND OF THE INVENTION

1. Field of the Invention

The present invention relates to a laundry machine, and more particularly to a laundry machine capable of removing creases from laundry during a drying operation for the laundry.

2. Discussion of the Related Art

Typically, a laundry dryer, which is a kind of a laundry machine, is a home appliance used to dry laundry, mainly clothes, completely washed, using hot air. Generally, such a laundry dryer includes a drum for accommodating laundry to be dried therein, and a drive source for driving the drum, a heater for heating air introduced into the drum, and a blower unit for sucking air into the drum or outwardly discharging air from the drum.

Laundry dryers may be classified into an electric type and a gas type in accordance with the type of the system for heating air, namely, the type of the heater. The electric type laundry dryer heats air, using heat generated from an electrical resistance. On the other hand, the gas type laundry dryer heats air, using heat generated in accordance with the combustion of gas.

Laundry dryers may also be classified into a condensation type and an exhaustion type. In the condensation type laundry dryer, air, which has become humid after being heat-exchanged with laundry to be dried, is circulated without being outwardly discharged. The air is heat-exchanged with ambient air through a separate condenser. In accordance with this heat exchange, condensed water is generated, and is then outwardly discharged. In the exhaustion type laundry dryer, air, which has become humid after being heat-exchanged with laundry to be dried, is directly discharged to the outside of the laundry dryer.

Laundry dryers may also be classified into a top loading type and a front loading type in accordance with the laundry loading type. In the top loading type laundry dryer, laundry to be dried is loaded into the laundry dryer through the top of the laundry dryer. On the other hand, in the front loading type laundry dryer, laundry to be dried is loaded into the laundry dryer through the front side of the laundry dryer.

Meanwhile, conventional laundry dryers as mentioned above have the following problems.

Typically, in a laundry dryer, laundry spin-dried after being completely washed is loaded so that it can be dried. In this case, the laundry, which has been washed using water, has creases due to the principle of the water washing. In the drying procedure carried out in the laundry dryer, however, the creases cannot be completely removed. In order to remove the creases still present on objects, such as laundry, completely dried in conventional drying machines, it is necessary to perform ironing.

Where clothes other than laundry completely washed are stored or used in a typical manner, creases, rumples, or holds (hereinafter, generally referred to as "creases") may be formed at the clothes. To this end, it has been required to develop an apparatus capable of conveniently removing creases generated during the storage or use of clothes.

SUMMARY OF THE INVENTION

Accordingly, the present invention is directed to a laundry machine that substantially obviates one or more problems due to limitations and disadvantages of the related art.

An object of the present invention is to provide a laundry machine capable of avoiding the formation of creases on clothes, etc. and/or removing creases formed on clothes, etc.

Another object of the present invention is to provide a laundry machine capable of preventing a water supply device from being completely separated to be in an unsupported state, and preventing the water supply device from being downwardly inclined.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine comprises: a drum rotatably installed in a cabinet; a substance supply device for supplying moisture to the drum; a water supply device movably installed in the cabinet such that the water supply device is selectively exposed to an outside of the cabinet; and a stopper for preventing the water supply device from being completely separated from the cabinet when the water supply device is ejected from the cabinet.

In another aspect of the present invention, a laundry machine comprises: a drum rotatably installed in a cabinet; a substance supply device for supplying moisture to the drum through a moisture supply unit; a water supply device installed in the cabinet such that the water supply device is inserted into and ejected from the cabinet, to supply water to the moisture supplier; a stopper for preventing the water supply device from being completely separated from the cabinet when the water supply device is ejected; an second stopper for preventing the water supply device from being downwardly inclined when the water supply device is ejected; and a fixing unit for preventing the substance supply unit from being downwardly loosened.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
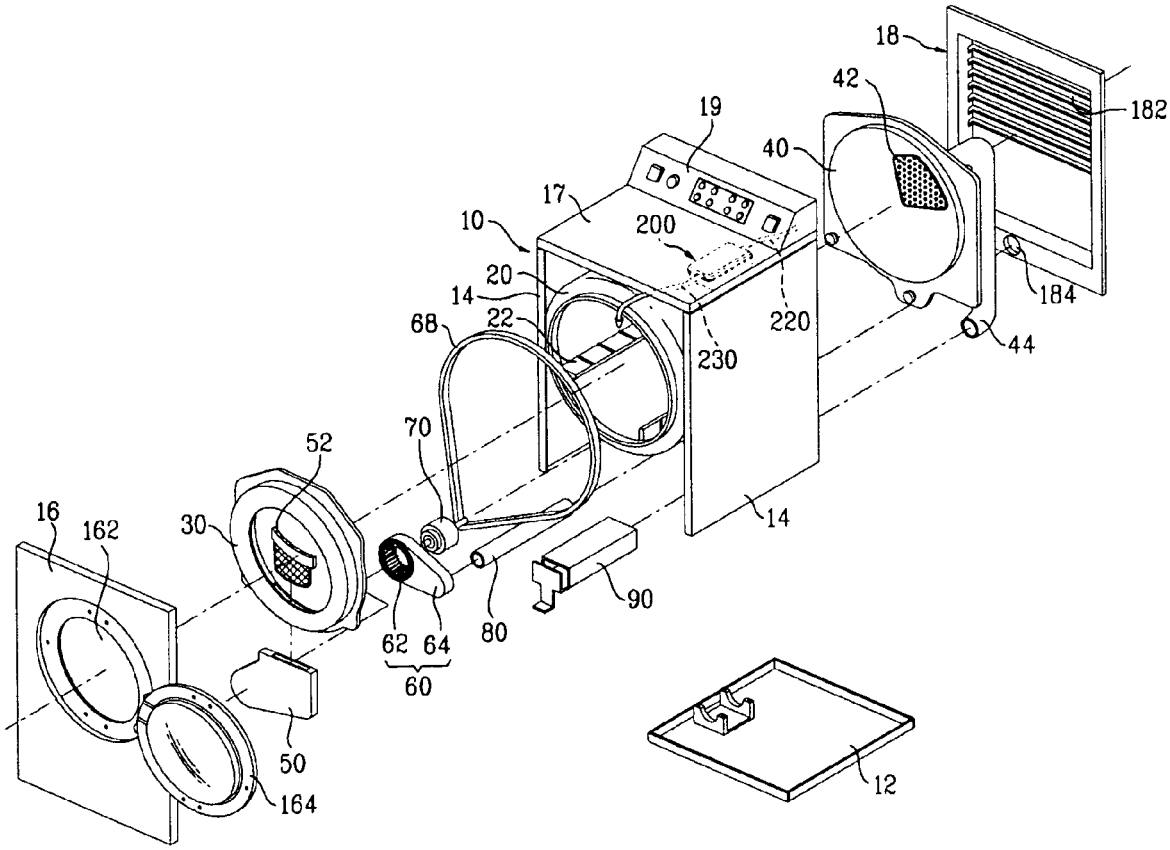
FIG. 1 is an exploded perspective view illustrating a laundry machine according to a preferred embodiment of the present invention.

FIG. 1 is an exploded perspective view illustrating an exploded state of a laundry machine according to a preferred embodiment of the present invention.

Hereinafter, the laundry machine according to the illustrated embodiment of the present invention will be described with reference to FIG. 1.

A cabinet 10 forms an outer structure of the laundry machine, namely, a laundry dryer, according to the present invention. Various constituent elements of the laundry dryer are arranged in the interior of the cabinet 10. That is, a rotatable drum 20, and a motor 70 and a belt 68, which are adapted to drive the drum 20, may be installed in the cabinet 10. An air heater 90 may be arranged in the cabinet 10 at a desired position, to heat air, and thus to generate hot air. A hot air supply duct 44 may also be arranged in the cabinet 10, to supply the hot air generated by the air heater 90 to the drum 20. In the cabinet 10, an exhaust duct 80 for exhausting humid air heat-exchanged with objects to be dried in the drum 20, and a blower unit 60 for sucking the humid air may also be arranged. Meanwhile, a substance supply device may be arranged in the cabinet 10 at a desired position, to supply water based substance, e.g. mist or steam to the drum 20.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the outer structure of the laundry machine, namely, the laundry dryer, may include a base 12 forming a bottom wall, a pair of side covers 14 extending vertically from the base 12, a front cover 16 mounted to the front ends of the side covers 14, a rear cover 18 mounted to the rear ends of the side covers 14, and a top cover 17 disposed on the upper ends of the side covers 14. A control panel 19, which includes various operating switches or the like, may be arranged on the top cover 17 or front cover 16. A door 164 may be mounted to the front cover 16. A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. A lift 22 may be installed in the drum 20, to drop laundry after raising the laundry such that the laundry is turned over, and thus to achieve an enhancement in drying efficiency.

Meanwhile, a front supporter 30 and a rear supporter 40 may be installed between the drum 20 and the cabinet 10, namely, between the drum 20 and the front cover 16 and between the drum 20 and the rear cover 18, respectively. The drum 20 is rotatably installed between the front supporter 30 and the rear supporter 40. Sealing members (not shown) are fitted between the front supporter 30 and the drum 20 and between the rear supporter 40 and the drum 20, respectively, to prevent water leakage. That is, the front supporter 30 and rear supporter 40 close the front and rear ends of the drum 20, to define the drying chamber in the drum 20. The front supporter 30 and rear supporter 40 also function to support the front and rear ends of the drum 20.

An opening may be formed through the front supporter 30, to communicate the drum 20 with the outside of the laundry dryer. The opening is selectively opened or closed by the door 164. A lint duct 50, which is a passage for outwardly discharging air from the drum 20, is connected to the front supporter 30. A lint filter 52 may be installed in the lint duct 50.

One side of the blower unit 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52. Typically, the blower unit 60 includes a blower 62, and a blower housing 64. Typically, the blower 62 is connected to the motor 70, which drives the drum 20.

An opening 42, which is constituted by a plurality of through holes, may be formed through the rear supporter 40. A hot air supply duct 44 may be connected to the opening 42. The hot air supply duct 44 communicates with the drum 20, to function as a passage for supplying hot air to the drum 20. To this end, the air heater 90 may be installed at a certain position in the hot air supply duct 44.

A substance supply device may be installed at a desired position in the cabinet 10, to supply water based substance, e.g. mist or steam to the drum 20. Thus, the substance supply device functions to supply water based substance to the drum 20.

For example, the substance supply device includes a pressure apply device, which applies a certain pressure to water supplied to the drum 20, and thus to supply mist to the drum 20 through a substance supply unit, which will be described later. In this case, the pressure apply device may comprise a separate pump. Alternatively, a water supply line included in the laundry dryer may be directly connected to an external city water tap, to apply water supplied by the water supply line to a certain pressure in accordance with the water pressure from the city water tap. When water is supplied under pressure, it can be sprayed into the interior of the drum 20 through a nozzle or the like included in the substance supply unit, in the form of mist.

Meanwhile, in the illustrated embodiment of the present invention, a steam generator 200, which generates steam, and supplies the generated steam into the interior of the drum 20, functions as the substance supply device. Hereinafter, the steam generator will be described with reference to the accompanying drawings.

Figure 2:
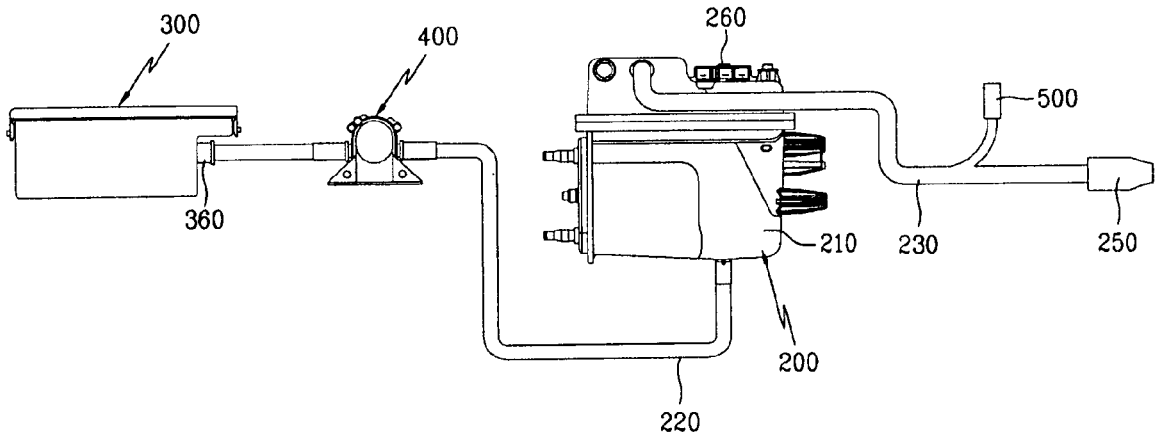
FIG. 2 is a view schematically illustrating a cartridge to supply water and a steam generator, which are included in the laundry machine of FIG. 1 in accordance with an exemplary embodiment of the present invention.

FIG. 2 is a side view illustrating the steam generator shown in FIG. 1. Hereinafter, the steam generator 200 will be described in detail with reference to FIG. 2.

The steam generator 200 includes a water tank 210 for containing water therein, a heater 240 mounted in the water tank 210, a water level sensor 260 for measuring the water level of the steam generator 200, and a temperature sensor 270 for measuring the temperature of the steam generator 200.

A water supply hose 220 is connected to one side of the steam generator 200, to supply water to the steam generator 200. A substance supply hose 230 is connected to the other side of the steam generator 200, to discharge steam from the steam generator 200. Preferably, a substance supply unit 250 is arranged at an end of the substance supply hose 230 opposite to the steam generator 200, to spray steam. Preferably, a safety valve 500 is also arranged in a steam line, namely, the substance supply hose 230, which discharges steam from the steam generator 200.

Although the steam generator 200 has been illustrated and described as being of a system in which a certain amount of water contained in the water tank 210, which has a certain size, is heated by the heater 240, to generate steam (hereinafter, referred to as a "barrel heating system", for the convenience of description), the present invention is not limited thereto. In the present invention, any steam generator can be used, as long as it can generate steam. For example, a system, in which a heater is installed around a water supply hose, through which water flows, namely, a system heating water under the condition in which the water is not contained in any space (hereinafter, referred to as a "pipe heating system", for the convenience of description), may be used.

In accordance with this embodiment, a water supply source, which supplies water to the steam generator 200, may be detachably installed. Although not shown, the water supply source may be fixedly installed. Although the water supply source may be a city water tap, there is a difficulty in connecting the steam generator 200 to the city water tap. This is because no water is used in a typical laundry dryer. That is, when the city water tap is used as a water supply source, it is necessary to additionally install various devices associated with the city water tap. Therefore, there is a convenience in the case in which a detachable water supply source 300 is used in such a manner that water is supplied to the water supply source 300 in a separated state of the water supply source 300, and the water-filled water supply source 300 is then connected to the water supply line of the steam generator 200, namely, the water supply hose 220.

Preferably, a pump 400 may be arranged between the water supply source 300 and the steam generator 200. More preferably, the pump 400 is rotatable in normal and reverse directions, not only to supply water to the steam generator 200, but also to recover residual water from the steam generator 200, if necessary. The reason why residual water is recovered from the steam generator 200 is that, when the steam generator 200 is not used for a prolonged period of time, the residual water may cause damage to the heater of the steam generator 200, or may be used in a decomposed state.

Figure 3:
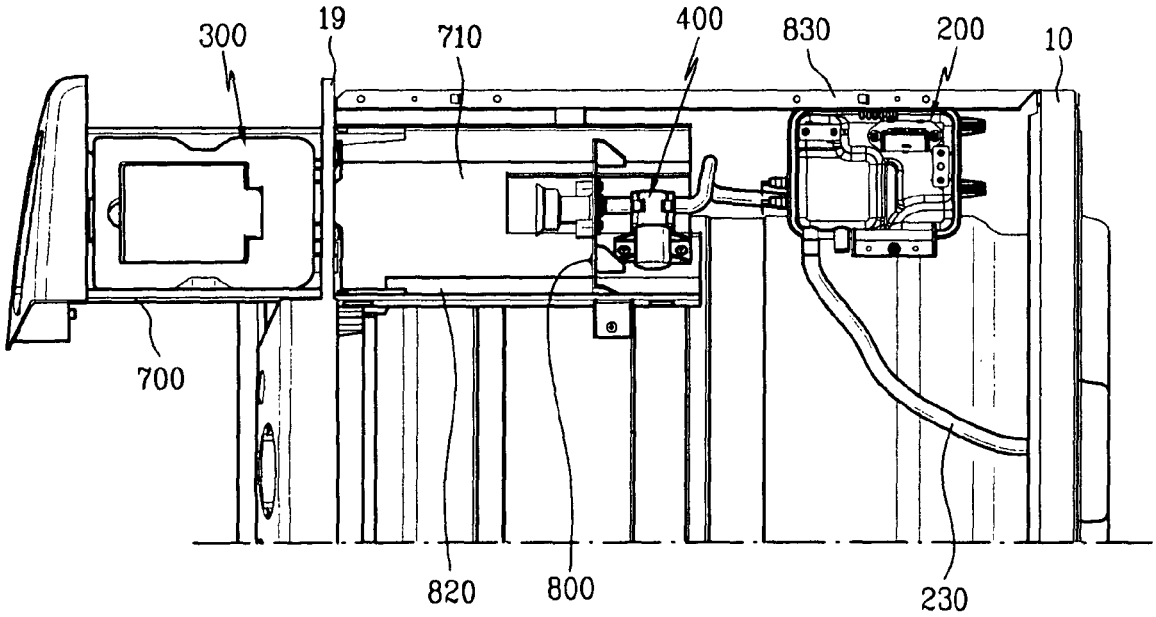
FIG. 3 is a plan view schematically illustrating a water supply device included in a laundry machine according to another embodiment of the present invention.

Hereinafter, a configuration, in which a cartridge functioning as the water supply source in the laundry machine according to the illustrated embodiment of the present invention is installed in the cabinet, will be described with reference to the accompanying drawings. FIG. 3 is a perspective view illustrating a configuration in which the cartridge is installed in the cabinet in a laundry machine according to a preferred embodiment of the present invention.

Referring to FIG. 3, the laundry machine according to the illustrated embodiment of the present invention may include a drawer 700, which is movably installed in the cabinet 10 such that the drawer 700 can be selectively exposed to the outside of the cabinet 10. The cartridge 300 may be selectively mounted in the cartridge 300. That is, the cartridge 300 is selectively mounted in the drawer 700 so that it functions as a water supply device to supply water to the steam generator 200.

Where the cartridge 300 is mounted as described above, it is preferred that the drawer 700 be separably installed in the cabinet 10, and the cartridge 300 be mounted in the drawer 700, as compared to a configuration in which the cartridge 300 is separably installed in the cabinet 10 in a direct manner.

The drawer 700 may be separably installed at one side of the cabinet 10 such that it can be selectively exposed to the outside of the cabinet 10. That is, the drawer 700 can be inserted into and pulled out from the cabinet 10. Preferably, the drawer 700 is separably installed at the front-side of the cabinet 10. In detail, the drawer 700 is installed at the front side of the cabinet 10 such that it can be slidably inserted into and pulled out from the interior of the cabinet 10. The sliding movement of the drawer 700 is guided by a drawer guide 710, which is installed at one side of the cabinet 10. The drawer guide 710 will be described in detail later.

The cartridge 300 may be detachably mounted in the drawer 700. The cartridge 300 contains water to be supplied to the steam generator 200. In the illustrated case, the cartridge 300 is separably mounted in the drawer 700. When it is desired to supply water to the laundry machine, the user pull out the drawer 700, and then separates the cartridge 300 from the drawer 700. After filling water in the separated cartridge 300, the operator mounts the water-filled cartridge 300 in the drawer 700, and then inserts the drawer 700 into the interior of the cabinet 10.

Where the drawer 700 is movable as described above, it is preferred that a drawer guide 710 be provided at the cabinet 10, to guide the movement of the drawer 700. The drawer guide 710 is formed at an inner surface of the cabinet 10 such that it extends from an opening formed at the front side of the cabinet 10 into the interior of the cabinet 10. Preferably, the drawer guide 710 has a shape corresponding to an outer structure of the drawer 700. In detail, it is preferred that a supporter 820 be installed in the rear of the control panel 19 such that it extends to be substantially parallel to a top frame 830, and the drawer guide 710 be arranged between the supporter 820 and the top frame 830. Although not shown, it is also preferred that a drawer guide cover 716 (FIG. 5) be provided to cover a top portion of the drawer guide 710.

Accordingly, it is possible to selectively connect the cartridge 300 to the pump 400 by mounting the cartridge 300 in the drawer 700, and then inserting the drawer 700 along the drawer guide 710.

Figure 4:
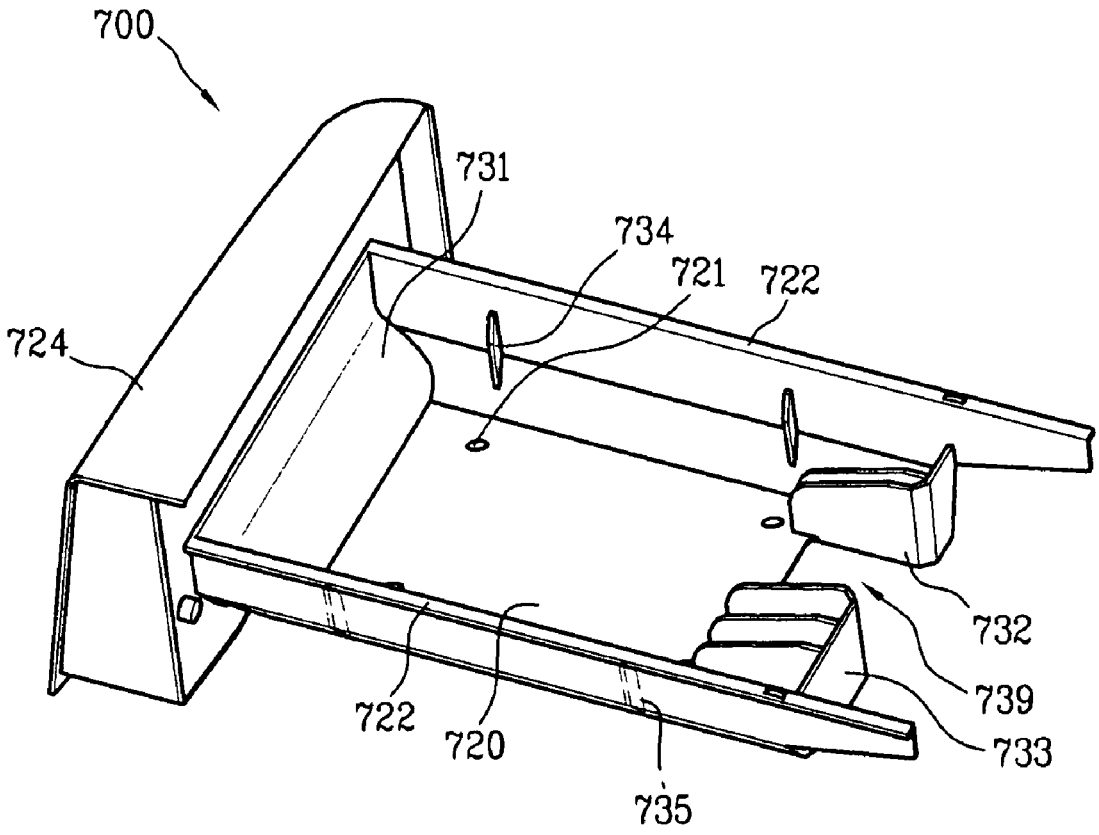
FIG. 4 is a perspective view illustrating a drawer shown in FIG. 3.

Hereinafter, the drawer 700, in which the cartridge 300 is mounted, will be described with reference to the accompanying drawings. FIG. 4 is a perspective view illustrating a structure of the drawer 700 according to a preferred embodiment of the present invention.

Referring to FIG. 4, the drawer 700 may substantially have an upwardly-opened box shape corresponding to the shape of the cartridge 300 (FIG. 3). In detail, the drawer 700 may include a base 720, and side walls 722 extending vertically from the base 720. The drawer 700 may also include a cover 724 arranged at a front side of the drawer 700, to enable the user to easily insert or eject the drawer 700 (hereinafter, an end toward an ejection direction of the drawer 700 is referred as a "front end", and an end opposite to the front end is referred to as a "rear end").

Meanwhile, a guide member and a positioning member may be provided in the drawer 700. The guide member functions to guide the cartridge 300 to a desired position in the drawer 700 when the cartridge 300 is mounted in the drawer 700. The positioning member functions to position the cartridge 300 at a correct position.

The guide member may comprise a protrusion 731 inwardly protruded from a front end of the drawer 700 in the interior of the drawer 700, at least one first guide 732 arranged at a rear end of the drawer 700, and second guides 734 and 735 respectively inwardly protruded from opposite side walls of the drawer 700 in the interior of the drawer 700.

In this case, the guide member may be formed such that the distance between the protrusion 731 and the first guide 732 corresponds to the length of the cartridge 300, and the distance between the second guides 734 and 735 corresponds to the width of the cartridge 300. Accordingly, when the cartridge 300 is mounted in the drawer 700, it is positioned in a space defined by the protrusion 731, first guide 732, and second guides 734 and 735.

Although not shown, the positioning member may comprise a positioning protrusion (not shown) formed at an outer bottom surface of the cartridge 300, and a positioning groove (not shown) formed at an inner bottom surface of the drawer 700. Accordingly, when the cartridge 300 is positioned in the space defined by the protrusion 731, first guide 732, and second guides 734 and 735, the positioning protrusion of the cartridge 300 is inserted into the positioning groove 721 of the drawer 700, so that the cartridge 300 can be positioned at a correct position.

Meanwhile, it is preferred that an opening 739 be formed through the rear end of the drawer 700, to provide a space, through which a connector 360 (FIG. 2) provided at the cartridge 300 can be connected to the cartridge 300, when the cartridge 300 is to be connected to the pump 400.

After mounting the cartridge 300 in the interior of the drawer 700, as described above, the user moves the drawer 700 into the cabinet 10 along the drawer guide 710, to connect the cartridge 300 to the pump 400.

Meanwhile, when the above-described drawer 700, in which the cartridge 300 is mounted, is pulled out, the drawer 700 may be completely separated from the cabinet 10. In this case, the drawer 700 may be in an unsupported state. When the drawer 700 is in an unsupported state, there is a possibility that the user may drop the drawer 700 to the floor. In particular, when the user drops the drawer 700 to the floor in a state in which water is filled in the cartridge 300, there may be a danger that the drawer 700 injures the foot or another body portion of the user.

Even when the user carefully pulls out the drawer 700 to prevent the drawer 700 from being completely separated, the cover 724 may be downwardly inclined due to the weight thereof in a state in which the drawer 700 is pulled out to a maximum ejection position. In particular, the downward inclination of the drawer 700 may be severe in a state in which water is fully filled in the cartridge 300 mounted in the drawer 700.

To this end, in accordance with the present invention, a first stopper and a second stopper are provided, to confine a position of the drawer 700 when the drawer 700 is pulled out and confine a degree of tilt of the drawer 700 when the drawer 700 is pulled out. These units will be described hereinafter.

The first stopper includes a hook 750 provided at the drawer 700, and an engagement step 713 (FIG. 5) provided at the drawer guide 710 (FIG. 3).

Preferably, the hook 750 is arranged at one side of a rear end of the drawer 700. Although a single hook 750 is illustrated, the present invention is not limited thereof. At least two hooks 750 may be provided. Although the hook 750 may be arranged at any position on the rear end of the drawer 700, it is preferred that the hook 750 be arranged at the opening 739 formed through the rear end of the drawer 700.

Also, although the configuration, in which the hook 750 is provided at the drawer 700, and the engagement step 713 is provided at the drawer guide 710, is illustrated, the present invention is not limited thereto. A configuration, in which the engagement step 713 is provided at the drawer 700, and the hook 750 is provided at the drawer guide 710, or a configuration, in which one hook 750 and one engagement step 713 are provided at each of the drawer 700 and drawer guide 710, may be implemented.

When the drawer 700 is pulled out, the hook 750 of the drawer 700 is engaged with the engagement step 713, thereby confining a position of the drawer and preventing the drawer 700 from being completely separated. A detailed operation of the above-described configuration will be described later.

Meanwhile, the second stopper includes at least one protrusion 740 formed at the rear end of the drawer 700, and a support member engageable with the protrusion 740, to prevent an inclination of the drawer 700.

The protrusion 740 may be protruded from the rear end of the drawer 700, in detail, an upper end of one side wall 722 of the drawer 700. The number of protrusions 740 is not limited to a fixed number, and may be appropriately variable.

Where the protrusion 740 is provided at the drawer 700, the support member may be provided at the cabinet 10, in order to support the protrusion 740, and thus to prevent the drawer 700 from being upwardly raised. In the present invention, the drawer guide cover 716 (FIG. 5) mounted to the top of the drawer guide 710 (FIG. 5) may function as the support member. Preferably, the height of the protrusion 740 from the side wall 722 corresponds to the gap between the side wall 722 and the drawer guide cover 716. In this case, when the drawer 700 is pulled out, the protrusion 740 of the drawer 700 comes into contact with a lower surface of the drawer guide cover 716, thereby confining a degree of tilt of the drawer and preventing the rear end of the drawer 700 from being raised.

Although the protrusion 740 is provided at the drawer 700, the present invention is not limited thereto. Alternatively, the protrusion may be provided at the drawer guide cover 716, and the side wall 722 of the drawer 700 may function as the support member.

Hereinafter, the structure of the drawer guide 710 functioning to guide the movement of the drawer 700 will be described.

Figure 5:
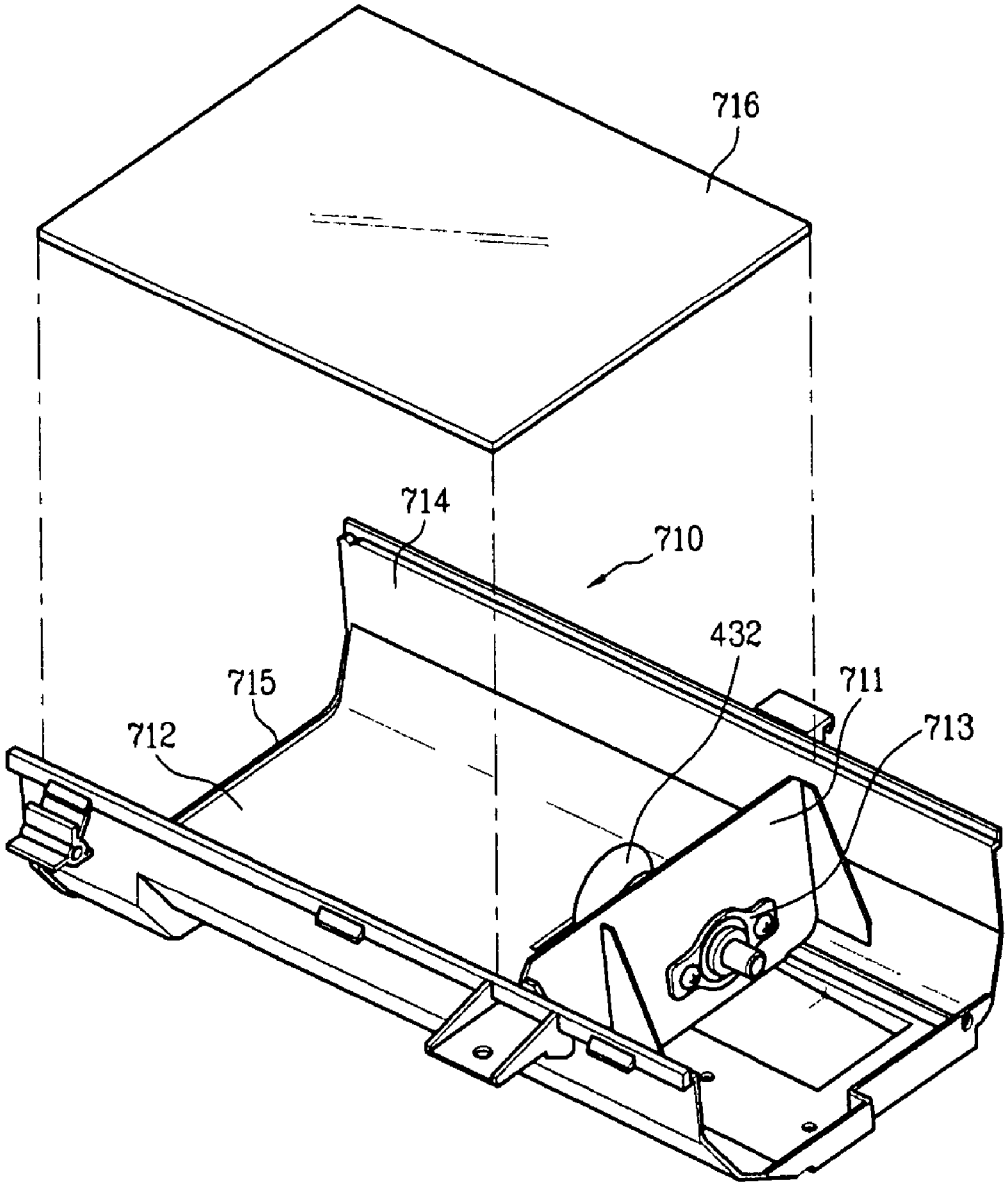
FIG. 5 is a perspective view illustrating a drawer guide shown in FIG. 3.

FIG. 5 is a perspective view illustrating an exemplary embodiment of the drawer guide 710 in the laundry machine according to the present invention.

Referring to FIG. 5, the drawer guide 710 may include a base 712, and a pair of side walls 714 extending vertically from opposite side ends of the base 712, respectively. The drawer guide 710 is arranged at the front side of the laundry machine, in order to guide the drawer 700 to be inserted into or pulled out from a space defined by the base 712 and side walls 714.

Meanwhile, the pump 400 (FIG. 3) may be arranged at a rear side of the drawer guide 710 so that the pump 400 can be connected with the cartridge 300 (FIG. 3). Accordingly, when the user inserts the drawer 700 into the laundry machine, the connector 360 (FIG. 2) of the cartridge 300 is connected to the pump 400. Accordingly, water from the cartridge 300 can be supplied to the steam generator 200.

Preferably, a shield plate 711 is provided at the drawer guide 710, to prevent the interior of the drawer 700, in particular, a rear portion of the drawer 700, from being open to the view in an pulled out state of the drawer 700. The shield plate 711 is mounted to the drawer guide 710 adjacent to the pump 400. A hole (not shown) is formed through the shield plate 711. A support bracket 713 is also arranged around the hole, to support a connector 432. Through the hole and support bracket 713, the connector 432 can be connected to an inlet (not shown) of the pump 400. Thus, when the drawer 700 is in an inserted state, the connector 360 of the cartridge 300 is connected to the connector 432, so that water from the cartridge 300 can be supplied to the pump 400.

The drawer guide cover 716 may be separably mounted to the top of the drawer guide 710. The drawer guide cover 716 selectively shields the top of the drawer guide 710, to prevent foreign matter from being introduced into the interior of the drawer guide 710. The drawer guide 716 also functions to prevent an inclination of the drawer 700, namely, a phenomenon that the drawer 700 is raised at the rear end thereof, when the drawer 700 is ejected, as described above.

As described above, the engagement step 715, which constitutes the first stopper, together with the hook 750 provided at the drawer 700, may be formed at a front end of the drawer guide 710. Preferably, the engagement step 715 has a height corresponding to that of the hook 750.

Hereinafter, operations of the first stopper and second stopper carried out when the drawer 700 is pulled out, in accordance with the present invention, will be described with reference to FIG. 6.

Figure 6:
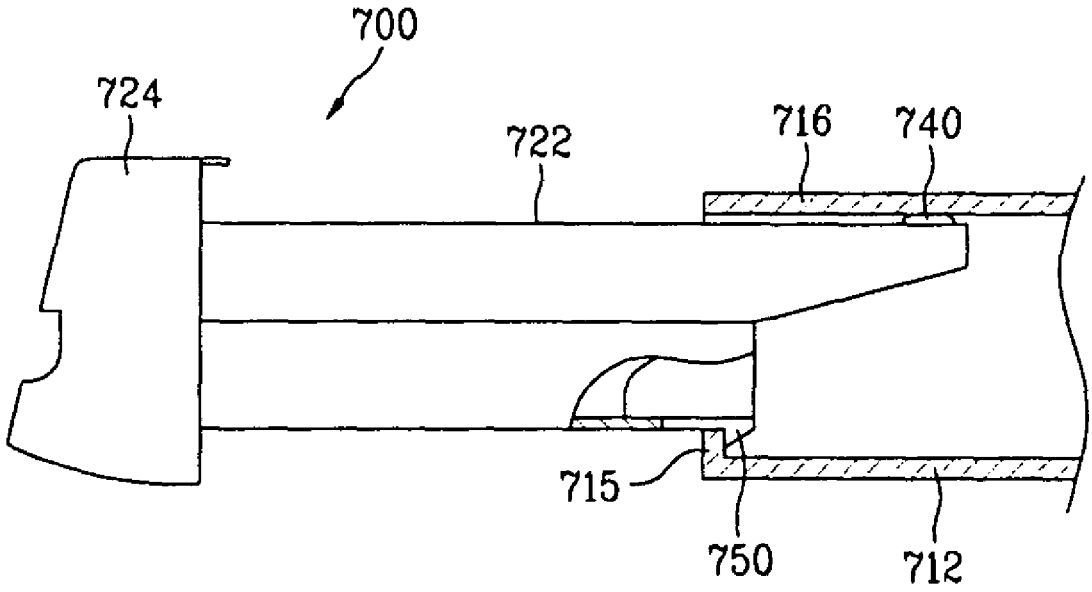
FIG. 6 is a partial sectional view corresponding to FIG. 3.

FIG. 6 is a partial sectional view illustrating when the drawer 700 is pulled out along the drawer guide 710.

Referring to FIG. 6, the hook 750 provided at the rear end of the drawer 700 is engaged with the engagement step 713 of the drawer guide 710 when the user pulls out the drawer 700 to a maximum ejection position. Accordingly, it is possible to confine the position of the drawer 700 and prevent the drawer 700 from being completely separated from the drawer guide 710, and thus to prevent the drawer 700 from being in an unsupported state.

Meanwhile, it is preferred that, where the drawer guide cover 176 is installed, a predetermined gap be defined between the lower surface of the drawer guide cover 716 and the drawer 700. In accordance with the gap, friction generated between the drawer 700 and the drawer guide cover 176 is reduced, so that the drawer 700 can be more smoothly ejected. However, when the above-described gap exists, the rear end of the drawer 700 is raised by the height corresponding to the gap when the drawer 700 is pulled out, so that the front end of the drawer 700 is downwardly inclined.

To this end, the present invention provides the protrusion 740 formed at the rear end of the drawer 700 and the second stopper constituted by the drawer guide cover 716, to confine the degree of tilt of the drawer and prevent the drawer 700 from being downwardly inclined when the drawer 700 is ejected That is, when the drawer 700 is pulled out along the drawer guide 710, the protrusion 740 formed at the rear end of the drawer 700 is engaged with the lower surface of the drawer guide cover 176, thereby preventing the rear end of the drawer 700 from being raised. As a result, the front end of the drawer 700 is prevented from being downwardly inclined.

Figure 7:
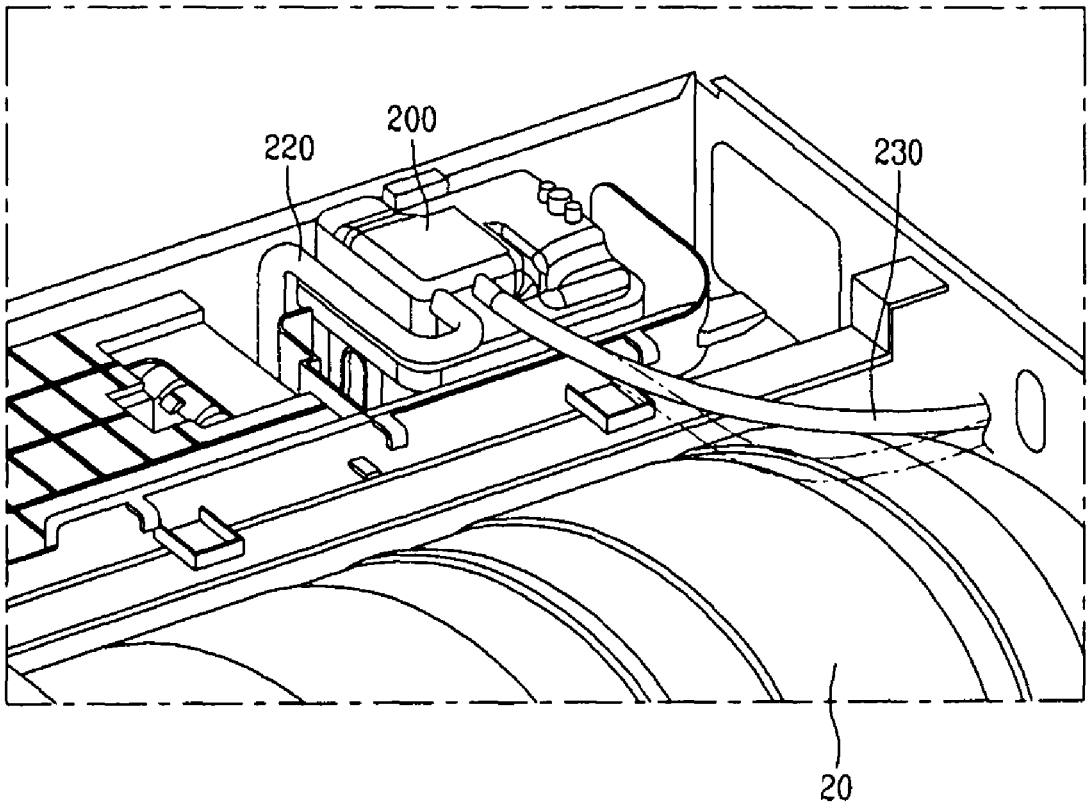
FIG. 7 is a perspective view illustrating a connected state of a substance supply hose shown in FIG. 3 in accordance with an exemplary embodiment of the present invention.

FIG. 7 is a perspective view illustrating an installed state of the substance supply hose 230 shown in FIG. 3.

Referring to FIG. 7, the substance supply hose 230, which is connected, at one end thereof, to the steam generator 200, extends toward the drum 20. The substance supply hose 230 constitutes the substance supply unit, which supplies water based substance to the drum 20, together with the nozzle 250 (FIG. 2) arranged at the other end of the substance supply hose 230, in the illustrated embodiment.

Meanwhile, preferably, the substance supply hose 230 is made of a flexible material. This is because it is advantageous to manufacture the substance supply hose 230, using a flexible material, for a desired arrangement of the substance supply hose 230 in the laundry machine, because the interior of the laundry machine is limited due to the arrangement of various constituent elements. Although it is possible to easily arrange the substance supply hose 230 in the limited space of the laundry machine when the substance supply hose 230 is made of a flexible material, as described above, there is a problem in that the substance supply hose 230 may be downwardly deflected due to the flexibility thereof.

This will be described hereinafter. The substance supply hose 230 is connected, at one end thereof, to the steam generator 200 arranged adjacent to the drum 20. The other end of the substance supply-hose 230 is arranged in the drum 20 at a desired position. Thus, the substance supply hose 230 may extend over the top of the drum 20. In an initially-installed state, the substance supply hose 230 is maintained as indicated by a solid line in FIG. 7. However, the substance supply hose 230 is downwardly deflected with the lapse of time, as indicated by a dotted line in FIG. 7, as it is influenced by the weight thereof and vibration generated in the laundry machine.

When the substance supply hose 230 is downwardly deflected, a portion of the substance supply hose 230 may come into contact with the drum 20. In this case, noise may be generated due to the vibration of the drum 20. Also, the substance supply hose 230 may be damaged. That is, when the drum 20 rotates selectively in accordance with operation of the laundry machine, the deflected portion of the substance supply hose 230 contacting the drum 20 vibrates due to the rotation of the drum 20, so that noise may be generated. Furthermore, the rotating drum 20 continuously strikes the substance supply hose 230, so that the substance supply hose 230 may be broken. In this case, steam is leaked from the broken portion of the substance supply hose 230, thereby causing the laundry machine to be out of order.

To this end, the present invention provides a fixing unit capable of confining a degree of deflection of the substance supply hose 230.

Figure 8:
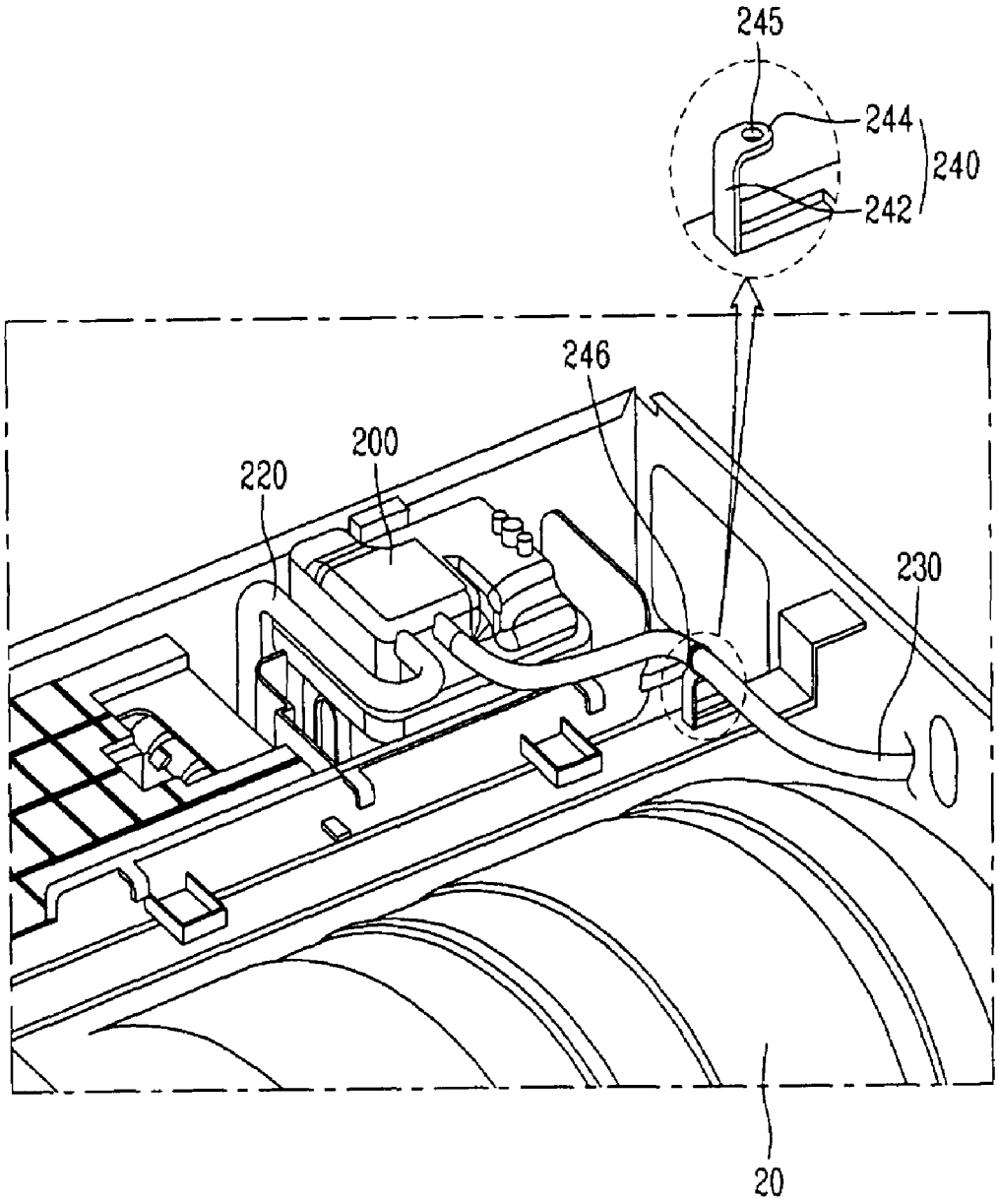
FIG. 8 is a perspective view illustrating a connected state of the substance supply hose shown in FIG. 3 in accordance with another embodiment of the present invention.

FIG. 8 is a perspective view illustrating a fixed state of the substance supply hose maintained by the fixing unit.

Referring to FIG. 8, the fixing unit includes a fixing flange 240 arranged adjacent to the drum 20, to support and fix the substance supply hose 230 such that the substance supply hose 230 is prevented from being downwardly deflected.

In detail, the fixing flange 240 may be mounted to the supporter 820 extending across the interior of the cabinet 10 at a position adjacent to the drum 20. In this case, the fixing flange 240 may comprise a separate member. In this case, the fixing flange 240 may be mounted to the supporter 820. Alternatively, the fixing flange 240 may be integrated with the supporter 820.

The fixing flange 240 may include an extension 242 fixed to the supporter 820 while extending from the supporter 820, and a fixing member 244 formed at a free end of the extension 242 in a bent state, to support and fix the substance supply hose 230, to prevent the substance supply hose 230 from being downwardly deflected.

The extension 242 has a certain length, and is fixedly formed at the supporter 820. There is no limitation on the position of the extension 242 on the supporter 820. The extension 242 may be formed at an appropriate position on the supporter 820.

Meanwhile, the fixing member 244 has a structure bent from the free end of the extension 242, in order to enable the substance supply hose 230 to be seated on the fixing member 244. In a state in which the substance supply hose 230 is seated on the fixing member 244, a fastener 246 is connected to the substance supply hose 230. Thereafter, an end of the fastener 246 is fastened through a fastening hole 245 formed through the fixing member 244, to fix the substance supply hose 230. Since the substance supply hose 230 is fixed in a state of being seated on the fixing flange 240, it is possible to prevent the substance supply hose 230 from being downwardly deflected, while firmly fixing the substance supply hose 230. In addition, it is possible to prevent the substance supply hose 230, which is made of a flexible material, from coming into contact with a sharp member, for example, the supporter 820, and thus preventing the substance supply hose 230 from being broken.

Although the fixing flange 240 has been described as being installed on the supporter 820, as in the embodiment of FIG. 8, it may be possible to install the fixing flange 240 at other positions, for example, at a position adjacent to the drum 20 within the cabinet 10.

Figure 9:
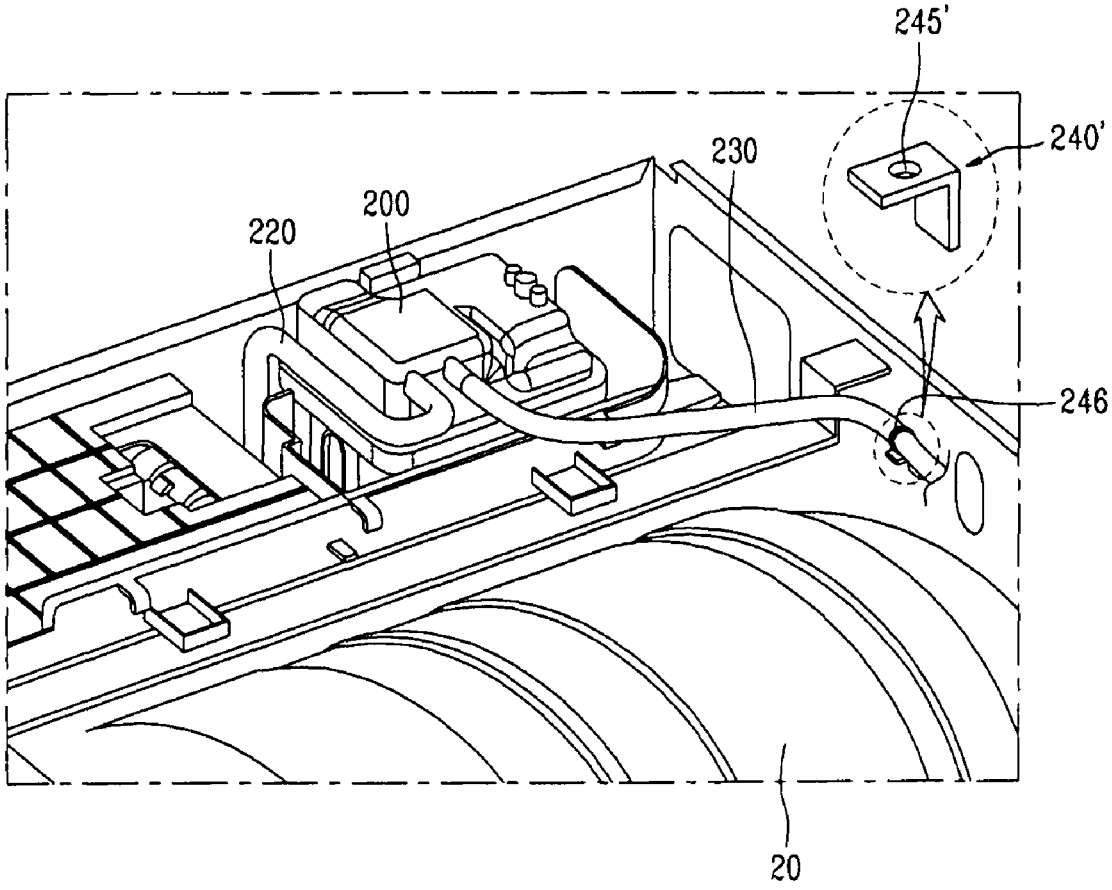
FIG. 9 is a perspective view illustrating a connected state of the substance supply hose shown in FIG. 3 in accordance with another embodiment of the present invention.

FIG. 9 illustrates an embodiment in which the position of the fixing flange 240 is different from the position of FIG. 8.

The embodiment of FIG. 9 is different from the embodiment of FIG. 8 in terms of a fixing flange 240' installed at a position different from that of FIG. 8.

As shown in FIG. 9, the fixing flange 204' in this embodiment may be mounted at an inner surface of the rear cover 18 forming the rear wall of the cabinet 10. In detail, the fixing flange 204' is fixed to the inner surface of the rear cover 18. The fixing flange 204' has a bent portion, which extends inwardly, to support the substance supply hose 230.

Meanwhile, a fastening hole 245' is formed at a position adjacent to a free end of the fixing flange 240'. The substance supply hose 230 is fixed in accordance with a fastening method applied to the fastening hole 145'. The fastening method is similar to that of the previous embodiment, so that no detailed description thereof will be given.

As apparent from the above description, the laundry machine according to the present invention provides the following effects.

The laundry machine can effectively remove creases or rumples possibly formed on clothes without performing ironing because steam is sprayed onto the clothes in a completely-dried state of the clothes.

In accordance with the present invention, the water supply device is prevented from being completely separated, and thus from being in an unsupported state, when it is ejected. Accordingly, it is possible to prevent the user from being injured, and to prevent the drawer from being damaged or broken.

In accordance with the present invention, the water supply device is prevented from being downwardly inclined when it is ejected. Accordingly, it is possible to achieve the convenience of the user, and to prevent the water supply device from being damaged or broken.

In accordance with the present invention, the moisture supply hose, which supplies steam to the drum, is prevented from being downwardly deflected. Accordingly, it is possible to prevent generation of noise caused by vibration of the moisture supply hose.

In accordance with the present invention, the substance supply hose is prevented from coming into contact with the rotating drum as the deflection of the substance supply hose is prevented. Accordingly, it is possible to prevent the substance supply hose from being damaged or broken.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum rotatably provided in a cabinet;

a substance supply device generating water based substance and supplying the water based substance to the drum;

a water supply device that is movably provided in the cabinet and supplies water to the substance supply device, wherein the water supply device comprises:

a drawer provided at one side of the cabinet such that the drawer is selectively inserted into or pulled out from the cabinet; and a cartridge that is detachably mounted in the drawer and accommodates water to be supplied to the water supply device;

a first stopper confining a position of the water supply device when the water supply device is pulled out from the cabinet; and a second stopper confining a degree of tilt of the drawer when the drawer is pulled out.

2. The laundry machine according to claim 1, further comprising a heater heating air and supplying hot air to the drum.

3. The laundry machine according to claim 1, wherein the substance supply device comprises a pressure apply device applying a predetermined pressure to water supplied to the drum.

4. The laundry machine according to claim 1, wherein the substance supply device comprises a steam generator generating steam and supplying the steam to the drum.

5. The laundry machine according to claim 1, wherein the first stopper comprises:

at least one hook provided at one of the drawer and the cabinet; and an engagement step provided at the other of the drawer and the cabinet such that the engagement hook is engageable with the hook.

6. The laundry machine according to claim 5, further comprising a drawer guide that is provided at the cabinet and guides a movement of the drawer, wherein the engagement step is provided at one side of the drawer guide.

7. The laundry machine according to claim 6, wherein the engagement step is provided at a front end of the drawer guide.

8. The laundry machine according to claim 1, wherein the second stopper comprises:

at least one protrusion provided at one of the drawer and the cabinet; and a support member that is provided at the other of the drawer and the cabinet such that the support member supports the protrusion and prevents the drawer from being downwardly inclined.

9. The laundry machine according to claim 8, further comprising a drawer guide that is provided at the cabinet and guides a movement of the drawer, wherein the protrusion is formed at a rear end of the drawer such that the protrusion extends upwardly, and the support member comprises a drawer guide cover arranged at a top of the drawer guide.

10. The laundry machine according to claim 1, further comprising:

a substance supply unit supplying the water based substance to the drum; and a fixing unit confining a degree of deflection of the substance supply unit.

11. The laundry machine according to claim 10, wherein the substance supply unit comprises a substance supply hose supplying moisture, and a nozzle spraying the water based substance; and the fixing unit comprises a fixing flange that is provided inside of the cabinet and fixes the substance supply hose.

12. The laundry machine according to claim 11, wherein the fixing flange comprises an extension provided inside of the cabinet, and a fixing member that is formed at an end of the extension in a bent state and fixes the substance supply hose.

13. The laundry machine according to claim 12, wherein the fixing flange further comprises a fastening member connected to a portion of the substance supply hose and being fastened through a fastening hole formed at the fixing member.

14. The laundry machine according to claim 11, wherein the fixing flange is provided adjacent to the drum.

15. The laundry machine according to claim 14, further comprising:

a guide supporting the substance supply device; and a supporter supporting the guide, wherein the fixing flange is provided at the supporter.

16. The laundry machine according to claim 14, wherein the fixing flange is provided at a rear cover of the cabinet.

17. The laundry machine according to claim 16, wherein the fixing flange is provided at one side of an upper surface of the rear cover.

* * * * *